US006801140B2

(12) United States Patent
Mäntyjärvi et al.

(10) Patent No.: US 6,801,140 B2
(45) Date of Patent: Oct. 5, 2004

(54) SYSTEM AND METHOD FOR SMART CLOTHING AND WEARABLE ELECTRONIC DEVICES

(75) Inventors: Jani Mäntyjärvi, Espoo (FI); Jyrki Hoisko, Oulu (FI); Juha Kaario, Tampere (FI); Jyrki Kimmel, Tampere (FI)

(73) Assignee: Nokia Corporation, Tampere (FI)

( * ) Notice: Subject to any disclaimer, the term of this patent is extended or adjusted under 35 U.S.C. 154(b) by 454 days.

(21) Appl. No.: 09/750,719

(22) Filed: Jan. 2, 2001

(65) Prior Publication Data

US 2002/0084901 A1 Jul. 4, 2002

(51) Int. Cl.[7] ..... G08G 1/123

(52) U.S. Cl. ..... 340/999; 340/573.1; 340/590; 24/381; 24/405

(58) Field of Search ..... 340/999, 573.1, 340/539, 590; 200/DIG. 2; 24/381, 405; 455/100

(56) References Cited

U.S. PATENT DOCUMENTS 5,555,490 A * 9/1996 Carroll ..... 361/686
5,774,338 A * 6/1998 Wessling, III ..... 361/730
6,031,166 A * 2/2000 Petrarca ..... 84/327

FOREIGN PATENT DOCUMENTS

WO 9831027 * 7/1998

OTHER PUBLICATIONS

E.R. Post et al., "E–broidery: Design and Fabrication of Textile–Based Computing", 2000, IBM.

* cited by examiner

*Primary Examiner*—Daryl Pope
(74) *Attorney, Agent, or Firm*—Antonelli, Terry, Stout & Kraus, LLP

(57) ABSTRACT

System and method for wearable electronic devices and smart clothing that includes integrating an electronic circuit into one or more fastening devices on an article of clothing. One or more electronic devices integrated with or attached to the clothing are controlled or monitored based on a position of the fastening device where the position relates to how much the fastening device is fastened.

37 Claims, 6 Drawing Sheets

SYSTEM AND METHOD FOR SMART CLOTHING AND WEARABLE ELECTRONIC DEVICES

BACKGROUND

1. Field of the Invention

This invention relates to wearable devices and smart clothes, and more specifically to automatic activation/deactivation of wearable devices and smart clothes.

2. Background Information

Clothing and fashion are important for a number of people. Clothing serves many functions, for example, protecting our skin and warming our body. Also, clothing can be made to be personalized to the wearer. People wear different kinds of clothes, casual, formal, fashionable, etc. Using clothing, people signal and express things about themselves such as mood, hobbies, status, etc.

Digital or smart clothing describes combining clothing with information technology. This includes the incorporation of digital devices as part of the clothing. The digital devices may be contained in the clothing, or attachable to the clothing. In order for digitality in clothing to be effective, the digitality must be cheap and washable. Further, there must be a method of activating the digital clothing devices. Moreover, it may be desired to know when an article of clothing has been closed, or whether a pocket is open or not.

Therefore, a need exists for a method of activating smart clothing, providing status information of different parts of the clothing to an electronic device integrated into or attached to the clothing, and providing interconnectability and control of electronic devices integrated into or attached to clothing.

SUMMARY

The present invention is directed to a method for controlling wearable electronic devices and smart clothing that includes: integrating an electronic circuit into one or more fastening devices on a piece of clothing; and controlling one or more electronic devices based on a position of the at least one fastening device.

Further, the present invention is directed to an article of clothing that includes: one or more fastening devices where some of the fastening devices contain an electronic circuit integral therewith; and one or more electronic devices where the electronic devices are controlled or monitored based on a position of the fastening device. The position of the fastening device determining how much the fastening device is fastened.

Moreover, the present invention is directed to a data zipper system that includes a zipper, one or more conductive cables, one or more sensors, and one or more controllers. The zipper includes a plurality of interlocking teeth. Each conductive cables includes two parts. Each of the two parts are integral with one tooth of a pair of conducting interlocking teeth that are part of the plurality of interlocking teeth. The two parts are brought into conducting positions completing the conductive cable when the pair of conducting interlocking teeth are interlocked. The conducting position allows information transfer through the conductive cable; Each sensor is operably connected to at least one conductive cable. Each controller is operably connected to at least one conductive cable and at least one sensor. The controllers may control the sensors.

The present invention is also directed to a zipper assembly that includes a zipper and one or more conductive cables.

The zipper includes a plurality of interlocking teeth. Each conductive cable includes two parts, where each of the two parts is integral with one tooth of a pair of conducting interlocking teeth that are part of the plurality of interlocking teeth. The two parts are brought into conducting positions forming the conductive cable when the pair of conducting interlocking teeth are interlocked. The conducting position allows information transfer through the conductive cables.

BRIEF DESCRIPTION OF THE DRAWINGS

The present invention is further described in the detailed description which follows in reference to the noted plurality of drawings by way of non-limiting examples of embodiments of the present invention in which like reference numerals represent similar parts throughout the several views of the drawings and wherein.

DETAILED DESCRIPTION

Figure 1:
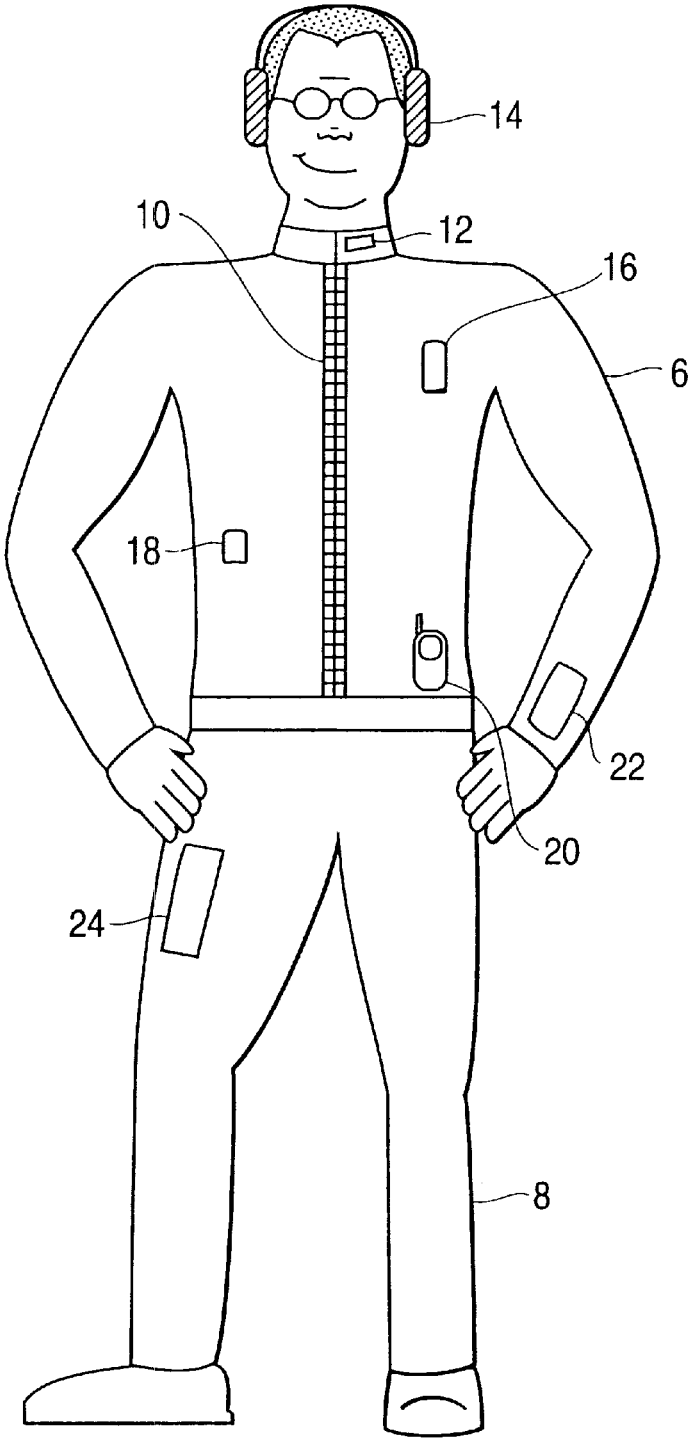
FIG. 1 is a diagram of a person wearing example clothing with electronic devices according to an example embodiment of the present invention.

The particulars shown herein are by way of example and for purposes of illustrative discussion of the embodiments of the present invention. The description taken with the drawings make it apparent to those skilled in the art how the present invention may be embodied in practice.

Further, arrangements may be shown in block diagram form in order to avoid obscuring the invention, and also in view of the fact that specifics with respect to implementation of such block diagram arrangements is highly dependent upon the platform within which the present invention is to be implemented, i.e., specifics should be well within purview of one skilled in the art. Where specific details (e.g., circuits, flowcharts) are set forth in order to describe example embodiments of the invention, it should be apparent to one skilled in the art that the invention can be practiced without these specific details. Finally, it should be apparent that any combination of hard-wired circuitry and software instructions can be used to implement embodiments of the present invention, i.e., the present invention is not limited to any specific combination of hardware circuitry and software instructions.

Although example embodiments of the present invention may be described using an example system block diagram in an example host unit environment, practice of the invention is not limited thereto, i.e., the invention may be able to be practiced with other types of systems, and in other types of environments (e.g., servers).

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

The present invention relates to systems and methods for activation of smart clothing and wearable electronic devices where fasteners with conductive elements on the clothing may be used to activate electronic devices that may be a part of or attached to the clothing, as well as provide status information regarding the state of the clothing to a controller or device attached to the clothing. These fasteners on the clothing may include any of many types of fasteners, e.g., a zipper, one or more buttons, one or more snaps, Velcro™, one or more hooks, etc.

In systems and methods according to the present invention, fasteners on the clothing may be monitored to determine if the fastener is totally unfastened, for example, a zipper that is open all the way, or what state the fastener is in, for example, a zipper that is halfway zipped, or all the way zipped. Depending on the status of the fastener, electronic devices, that are integrated into or attached to the clothing, may be activated or deactivated. The electronic device that is activated or deactivated may include any of many types of electronic devices. These may include, for example, earphones, head sets, microphones, lights, sensors, processors, wireless devices, displays, switches, receiving devices, storage devices, transmitting devices, audio devices, thermal devices, input/output devices, or power source devices. These are just some examples of devices that may be activated or deactivated, or monitored based on a position of a fastening device of an article of clothing. However, the present invention is not limited to these examples, and includes any and all types of electronic devices.

In systems and methods according to the present invention, conductive cables are imbedded into the fabric of the clothing or attached to the clothing. Preferably, the conductive cable has been sewn into the fabric of the clothing. The conductive cable may consist of wires composed of conductive metal such as copper, or may be composed of fiber optic fibers that are capable of conducting electric signals. Conductive fiberoptic fibers are advantageous since corrosion does not occur when the clothing is washed. Digital devices that are attached to or possibly embedded in the clothing are interconnected via the conductive cable of the clothing. The fastening devices on the clothing are also interconnected to the electronic devices by the conductive cabling. Therefore, according to one example embodiment of the present invention, when a fastening device of clothing that is currently unfastened is fastened completely, one or more electronic devices that are connected to the fastening device via conductive cable in the clothing may be activated.

Moreover, the fastening device may be part of a bus, a standard bus or other bus, and, therefore, once the fastening device is fastened, the individual signal lines that are part of the bus may be open when the fastening device in unattached, and connected when the fastening device is fastened. In this situation, the signal lines of a bus may need to be connected in a particular order to avoid causing damage to one or more devices that are attached to the bus. If the bus is part of a fastening device such as a zipper, since a zipper may only be fastened in a particular order (i.e., moving the zipper from an open position to a closed position), these individual signal lines of a bus may be attached to the teeth of a zipper in order to ensure that once the zipper is fastened, the signal lines of the bus are activated in a correct sequence to avoid electronic shock or other damage to devices attached to the bus.

The clothing may have connectors that are connected to the conductive cables that allow for attachment of various electronic devices to the clothing. This is advantageous in that the electronic devices may be removed from the clothing to allow the clothing to be washed or cleaned. Power to the various electronic devices that are attached to the clothing may come from one or more electronic devices that are also attached to or embedded in the clothing. For example, a mobile device such as a wireless phone or personal digital assistant (PDA) may supply power to one or more electronic devices of the clothing when the portable device is attached to the clothing. Since when the fastening devices of the clothing are not fastened, no electronic devices are activated, no excess power is consumed during the times when the fastening devices are not fastened. Further, power may be activated based on various positions of the fastening device. For example, if a fastening device is a zipper, and the zipper is closed half-way, it is possible that only a portion of the electronic devices are supplied with power. However, once the zipper is completely fastened, then all the electronic devices may now have power and be activated. Moreover, if more one than one device is used to supply power to devices of the clothing, the devices that are activated upon total closure of the fastening device may receive power from a different source than the devices that were activated when the zipper was only half-way closed.

FIG. 1 shows a diagram of a person wearing example clothing with electronic devices according to an example embodiment of the present invention. The person is wearing an article of clothing 6 (e.g., a shirt) and an article of clothing 8 (e.g., pants) that may include one or more electronic devices and/or fastening devices. The upper garment 6 includes a fastening device 10 which in this example embodiment is a zipper. Further, upper garment 6 includes electronic devices 12, 14, 16, 18, 20 and 22 that are attached to or integrated into garment 6. Lower garment 8 includes an electronic device 24. Electronic device 14 may be earphones in the form of headphones on the person's ears. Headphones 14 may be electrically attached to upper garment 6 via a wire or cable (not shown). Device 12 may be a microphone. Further, device 16 may be a light or other type of electronic device. Device 18 may be a sensor that is monitoring a bodily function of the user, or is monitoring the position of fastening device 10, or may be sensing parameters or characteristics external to clothing 6. Device 22 may be a display, that allows the user to view information regarding the attached electronic devices and/or the status of the fastening devices.

Moreover, device 22 may be a touch sensitive screen display whereby the user may input commands and/or data that may be used by the electronic devices connected to the clothing. Device 20 may be a mobile device such as a mobile phone. Device 20 may supply power to one or more other electronic devices connected to clothing 6 when device 20 is connected to clothing 6. Further, device 20 may serve as a controller that controls sensor devices and/or other electronic devices connected to clothing 6.

Clothing article 8 includes an electronic device 24 which may be a processing device, an input/output device, a power source, or other type of electronic device. Electronic devices on clothing 6 and electronic devices on clothing 8 may be interconnected by one or more cables between clothing 6 and clothing 8, or by one or more fastening devices that interconnect clothing 6 and clothing 8. Depending on the position of fastening device 10, one or more of electronic devices 12, 14, 16, 18, 20, 22 or 24 may be activated. Moreover, other fastening devices may exist on clothing 6 and/or clothing 8 that activate one or more electronic devices. For example, clothing 8 may have pockets that have fastening devices such as one or more buttons, snaps, hooks, zippers, or Velcro™, etc. Depending of the position of a fastening device, i.e., how many buttons are closed, how many snaps have been snapped, how far a zipper is zipped, how far a Velcro™ fastener is attached, one or more electronic devices may then be activated.

Although only one fastener and a limited number of electronic devices are shown in the example embodiment in FIG. 1, few or many fasteners and/or electronic devives may exits on an article of clothing and still be within the spirit and scope of the present invention. Moreover, example types of fasteners (zipper) and electronic devices (headphones, microphone, sensor, display, etc.) have been mentioned only to help illustrate the present invention but the present invention is not limited to these or any other types of fasteners and electronic devices. Further, the present invention is not limited to the positions on the clothing of the fasteners and/or electronic devices.

Figure 2:
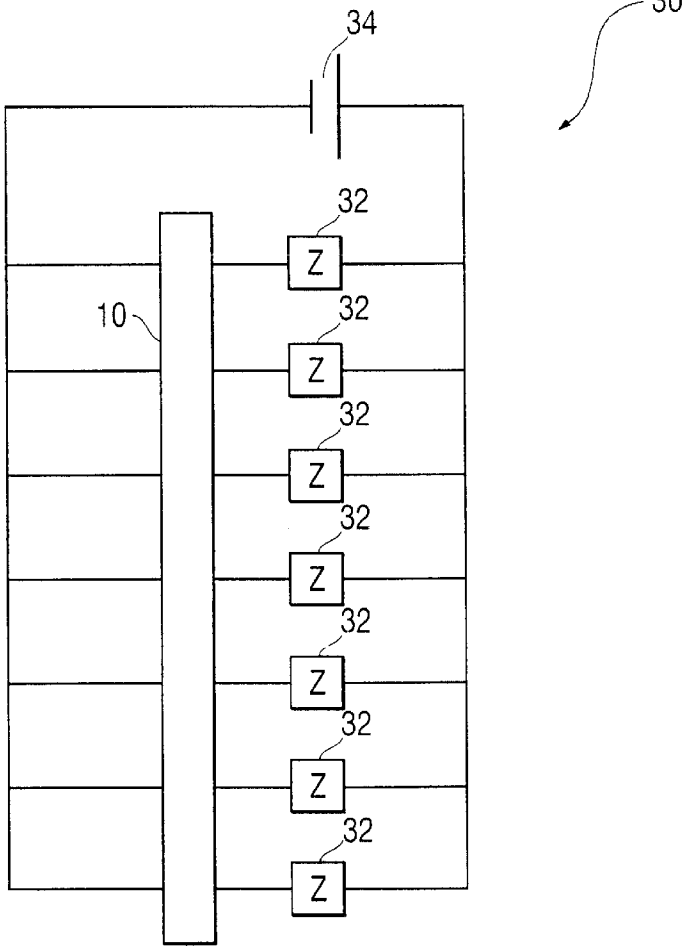
FIG. 2 is an example impedance circuit imbedded into a fastening device according to an example embodiment of the present invention.

FIG. 2 shows an example impedance circuit imbedded into a fastening device according to an example embodiment of the present invention. Impedance circuit 30 includes a power source 34 and one or more impedance devices 32 such as resistors, capacitors, gates, etc. The impedance circuit 30 may be integrated with fastening device 10 such that the impedance of impedance device 30 varies based on the position (i.e., the amount fastened) of fastening device 10. As stated previously, fastening device 10 may be any of many types of fastening devices that exist on clothing, for example, zipper, button, snap, hook, Velcro, etc. Depending on the position of fastening device 10, or how much fastening device 10 is fastened, the impedance in circuit 30 will vary accordingly. Therefore, impedance devices 32 in impedance circuit 30 may serve as switches that activate or deactivate an electronic device based on a position of fastening device 10. This allows a wearer of clothing with fastening device 10 to activate and deactivate one or more electronic devices or circuits based on how much of fastening device 10 is fastened. Moreover, impedance circuit 30 and fastening device 10 may together serve as a single switch that activates one or more electronic devices once fastening device 10 is fully fastened.

Figure 3:
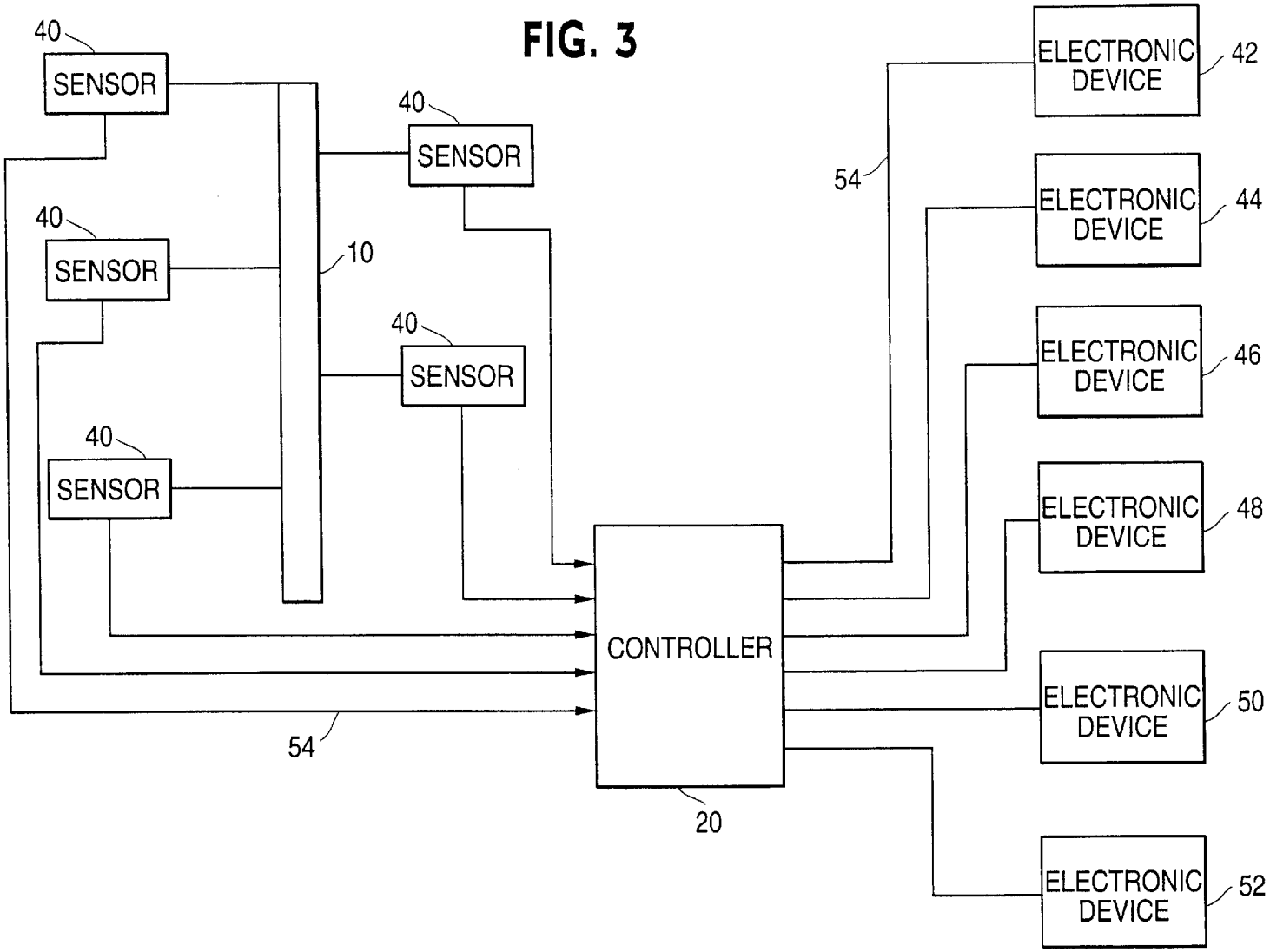
FIG. 3 is a system diagram of an example system for controlling wearable electronic devices and smart clothing according to an example embodiment of the present invention.

FIG. 3 shows a system diagram of an example system for controlling wearable electronic devices and smart clothing according to an example embodiment of the present invention. The system in FIG. 2 shows that one or more sensors 40 may be strategically connected to locations of fastening device 10 to monitor an amount of fastening of fastening device 10. The one or more sensors 40 may be controlled by a controller 20 via conductive cabling 54. Controller 20 may monitor sensors 40 to determine the amount fastening device 10 is fastened and, therefore, whether any of electronic devices 42–52 should be activated.

For example, if fastening device 10 is a zipper, as the zipper starts from an unzipped position and is zipped, the zipper travels along the path of the zipper. As the zipper reaches certain positions along the path of the zipper, sensors 40 may detect that the zipper has been zipped at their position, and send this information to controller 20. If enclosure 10 includes buttons or snaps, as the buttons are fastened or snaps are snapped, a sensor may monitor some or each button or snap to determine when it is fastened. Controller 20 monitors the sensors and, therefore, may activate one or more of electronic devices 42–52 based on information received from the sensors. Sensors 40, controller 20, and electronic devices 42–52, may be imbedded in clothing, or attachable to clothing.

Figure 4:
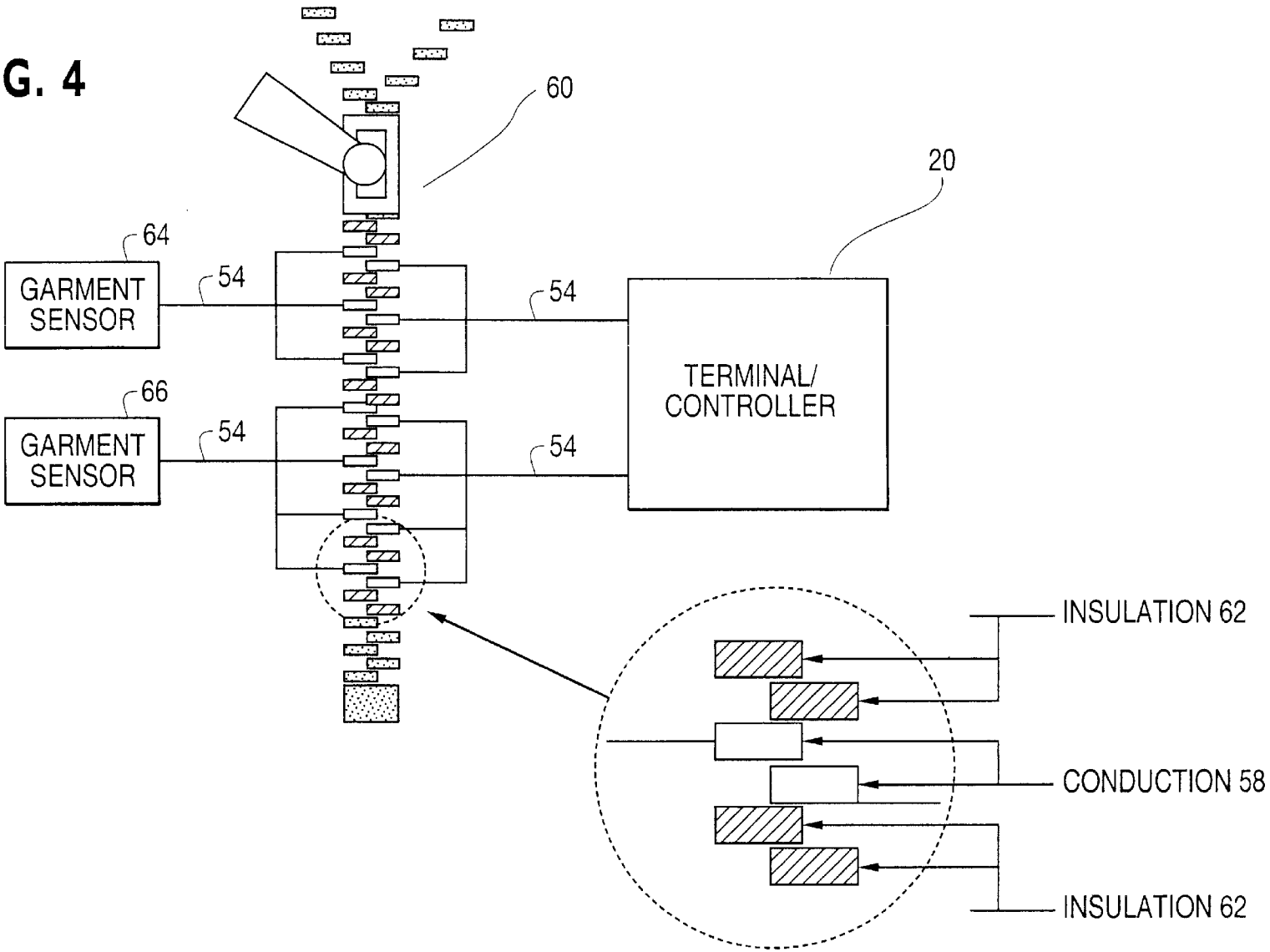
FIG. 4 is a diagram of an example zipper with conductive teeth according to an example embodiment of the present invention.

FIG. 4 shows a diagram of an example zipper with conductive teeth according to an example embodiment of the present invention. Zipper 60 includes a plurality of teeth where some may be conductive teeth 58, some may be insulating teeth 62, and some may be neither insulating nor conducting teeth 56. Conductive cables 54 connect to conduction teeth 58 and allow transfer of data and information through the conductive cable 54 and through conduction teeth 58 of zipper 60. Conduction teeth 58 are insulated from each other by teeth 62 which may be made of an insulating material or have insulation material around them. Zipper 60 may be part of an article of clothing that also includes one or more electronic devices (e.g., controller 20) or sensors 64, 66. Sensors 64 and 66, unlike sensors 40, may monitor a bodily function of the wearer of the clothing, for example, heart rate, blood pressure, pulse, perspiration, etc. Moreover, sensors 64 and 66 may monitor or measure parameters external to the clothing that zipper 60 is a part of, for example, temperature, wind, humidity, etc. The conduction teeth 58 of zipper 60 may connect conductive cables 54 that are part of a bus. Therefore, as zipper 60 is zipped from an unzipped position, various signal lines of a bus may become connected via the pairs of conduction teeth 58 in a correct order to prevent damage to electronic devices that may be connected to the bus via conductive cables 54. Although a fastening device of a zipper is shown in this embodiment, snaps, buttons, hooks, Velcro™, etc. may also be used as the fastening device and still be within the spirit and scope of the present invention. However, a zipper is advantageous if a desired order of connectivity is desired since a zipper may only be connected in a known fashion. In contrast, buttons, zippers, hooks, Velcro, etc. may be connectable in an unordered fashion.

Figure 5:
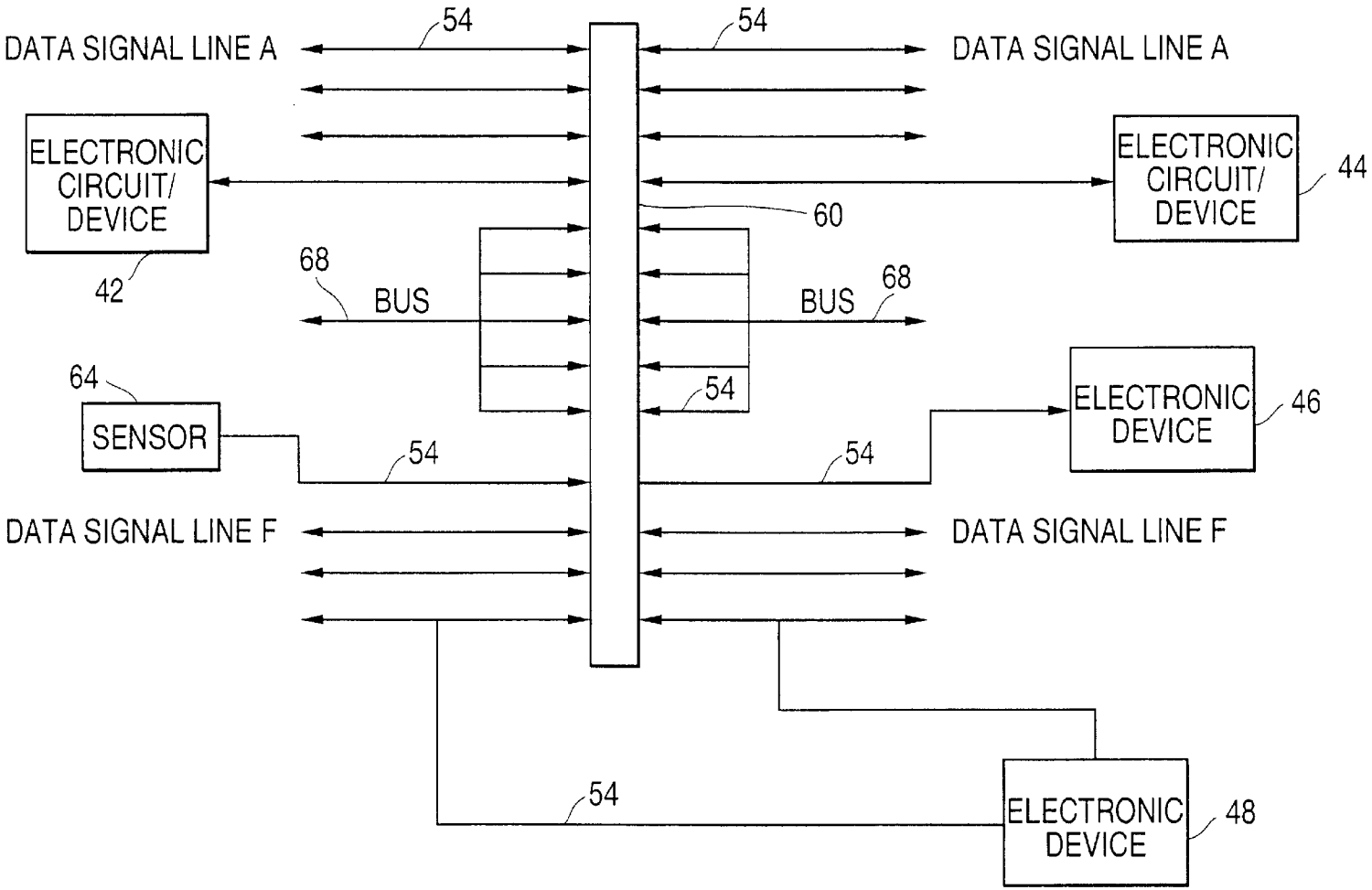
FIG. 5 is a system diagram of another example system for wearable devices and smart clothing according to an example embodiment of the present invention.

FIG. 5 shows a system diagram of another example system for wearable devices and smart clothing according to an example embodiment of the present invention. Fastening device 60 provides connections between a plurality of conductive cables 54. The conductive cables 54 provide data and information transfer between electronic devices, sensors, electronic circuits, etc., 42, 44, 46, 48 and 64. A group of conductive cables 54 may compose a bus 68. Bus 68 may be a user defined bus or a known standard bus, for example, a Universal Serial Bus (USB), IEEE (Institute of Electrical and Electronic Engineers) 488, etc. This bus may also be connected to one or more electronic devices or electronic circuits or sensors. Conductive cables 54 may be made of conductive metal, conductive fiber optic fibers, or any other conductive material.

Conductive optical fibers are advantageous since they may be suitable to withstanding washing of the clothing and are not prone to corrosion and wear. Further, optical fibers may stand temperatures and detergents commonly found in washing machines and driers. In systems and methods according to the present invention, it is preferable that a conductive optical fiber cable be a plastic multi-mode optical fiber operating at approximately between 650 to 660 nanometers. The diameter of the optical fiber is preferably between approximately 0.5 and 1 mm, and generally it is preferred that the jacket for these fiber optic cables be approximately 2.2 mm thick. Fastening devices may be manufactured to require tolerances for insertion of plastic fibers, thus securing minimal optical losses over the connection.

Figure 6A:
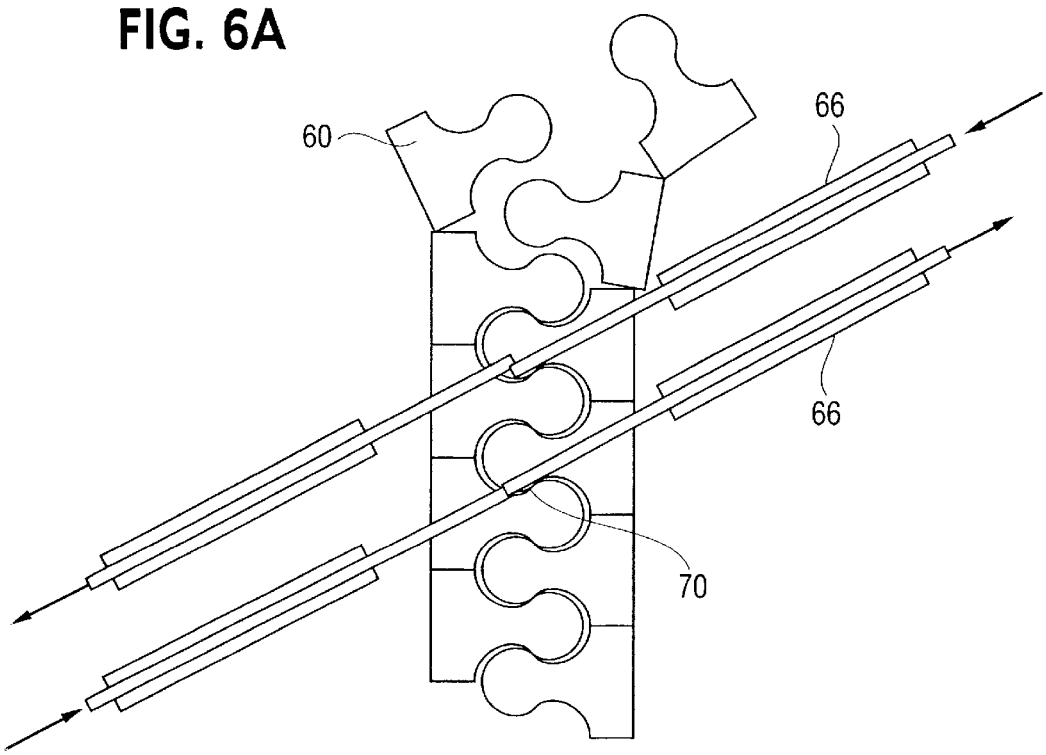
FIGS. 6A and 6B are diagrams of example implementations for connecting fiber optic cable in a zipper fastening device according to example embodiments of the present invention.
Figure 6B:
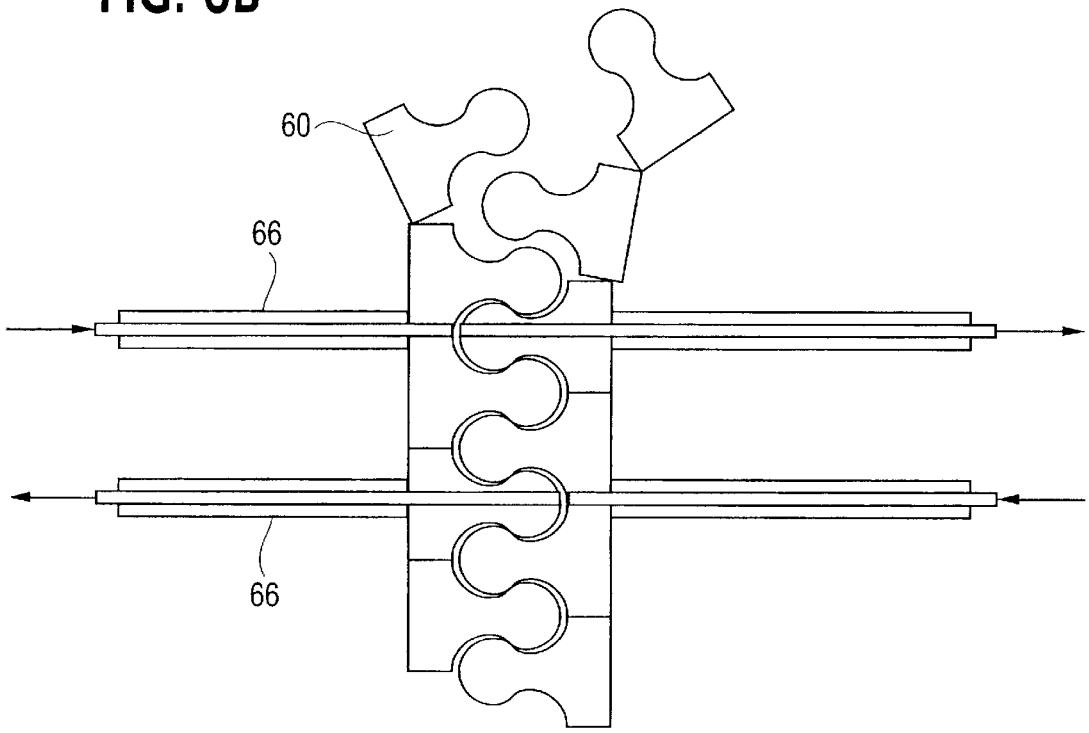

FIGS. 6A and 6B show diagrams of example implementations for connecting fiber optic cable in a zipper fastening device according to example embodiments of the present invention. As shown in FIG. 6A, the fiber optic cable may be manufactured in teeth of a zipper whereby each tooth of the zipper that includes a fiber optic cable includes a flat surface 70 where pairs of teeth may be connected together. The fibers meet end-to-end to provide the connective fiber optic cable. Moreover, as shown in FIG. 6B, all teeth in the zipper may be alike, however, possibly made out of a transparent material which allows the fiber optic cable to be connected end to end in a parallel fashion without touching and still maintain connectivity.

In another embodiment of the present invention, electronic devices attached to or imbedded in clothing may be activated when the clothing is put on by a person. Strain gages may reside in the cloth of the clothing at various locations, for example, the shoulders, sleeves, legs, etc., that may detect changes in the cloth (e.g., strain, tension, etc.) and activate one or more electronic devices accordingly. Sensor devices in the clothing may also detect other parameters, such as body heat, that cause activation of one or more electronic devices attached to or imbedded in the clothing.

Moreover, different types of clothing accessories may be attached to the clothing and activated upon attachment. These accessories may include sleeves, legs, scarves, gloves, etc. The accessories may have fastening devices, e.g., snaps, zippers, buttons, etc., that allow attachment of the accessory to an article of clothing. Once attached to the clothing, electronic devices attached to the accessory may then become activated.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made within the purview of the appended claims, as presently stated and as amended, without departing from the scope and spirit of the present invention in its aspects. Although the present invention has been described herein with reference to particular methods, materials, and embodiments, the present invention is not intended to be limited to the particulars disclosed herein, rather, the present invention extends to all functionally equivalent structures, methods and uses, such as are within the scope of the appended claims.

What is claimed is:

1. A method for controlling wearable electronic devices and smart clothing comprising:

integrating an electronic circuit into at least one fastening device on a piece of clothing; wherein the electronic circuit comprises at least one conductive cable including two parts of conductive optical fiber; and controlling at least one electronic device based on a position of the at least one fastening device, wherein the at least one electronic device is activated if the position of the at least one fastening device effectuates the two parts of conductive optical fiber being brought into conducting positions completing the at least one conductive cable.

2. The method according to claim 1, wherein the electronic circuit comprises an impedance circuit.

3. The method according to claim 1, further comprising weaving the at least one conductive cable into the fabric of the clothing, at least one conductive cable being connectable to the at least one electronic device.

4. The method according to claim 1, wherein the at least one conductive cable comprises conductive metal.

5. The method according to claim 1, wherein the at least one fastening device comprises at least one of a zipper, a button, a snap, a hook, and Velcro™.

6. The method according to claim 1, wherein the at least one electronic device comprises at least one of a headset, a microphone, a light, a sensor, a processor, a wireless device, a display, a switch, a receiving device, a storage device, a transmitting device, an audio device, a thermal device, an input/output device, and a power source.

7. The method according to claim 1, further comprising sensing the position of the at least one fastening device.

8. The method according to claim 7, further comprising controlling the at least one electronic device based on the sensing.

9. The method according to claim 1, further comprising performing the controlling using a mobile device, the mobile device being electrically connectable to the at least one fastening device.

10. The method according to claim 9, wherein the mobile device comprises one of a wireless phone, a mobile computing device, and a Personal Digital Assistant (PDA).

11. An article of clothing comprising:

at least one fastening device, some at least one fastening device containing an electronic circuit integral therewith wherein the electronic circuit comprises at least one conductive cable including two parts of conductive optical fiber; and at least one electronic device, the at least one electronic device being controlled based on a position of the at least one fastening device, wherein the at least one electronic device is activated if the position of the at least one fastening device effectuates the two parts of conductive optical fiber being brought into conducting positions completing the at least one conductive cable.

12. The article according to claim 11, wherein the electronic circuit comprises an impedance circuit.

13. The article according to claim 11, wherein the at least one conductive cable is woven into the fabric of the clothing, at least one conductive cable being connectable to the at least one electronic device.

14. The article according to claim 13, wherein the at least one conductive cable comprises conductive metal.

15. The article according to claim 11, wherein the at least one fastening device comprises at least one of a zipper, a button, a snap, a hook, and Velcro™.

16. The article according to claim 11, wherein the at least one electronic device is one of attached to and contained in the article of clothing.

17. The article according to claim 11, wherein the at least one electronic device comprises at least one of a headset, a microphone, a light, a sensor, a processor, a wireless device, a display, a switch, a receiving device, a storage device, a transmitting device, an audio device, a thermal device, an input/output device, and a power source.

18. The article according to claim 11, further comprising at least one sensor, the at least one sensor sensing at least one of the position of the at least one fastening device, a bodily function of a person wearing the article of clothing, and a condition external to the article of clothing.

19. The article according to claim 18, further comprising a controller, the mobile device being electrically connectable to the at least one fastening device, the controller controlling the at least one electronic device based on the sensing.

20. The article according to claim 19, wherein the controller comprises a mobile device.

21. The article according to claim 20, wherein the mobile device comprises one of a wireless phone, a mobile computing device, and a Personal Digital Assistant (PDA).

22. A data zipper system comprising:

a zipper, the zipper including a plurality of interlocking teeth;

at least one conductive cable, each at least one conductive cable including two parts of conductive optical fiber, each of the two parts being integral with one tooth of a pair of conducting interlocking teeth that are part of the plurality of interlocking teeth, the two parts being brought into conducting positions completing the at least one conductive cable when the pair of conducting interlocking teeth are interlocked, the conducting position allowing information transfer through the at least one conductive cable;

at least one sensor, the at least one sensor operably connected to at least one conductive cable; and at least one controller, the at least one controller operably connected to at least one conductive cable and the at least one sensor, the at least one controller controlling the at least one sensor.

23. The system according to claim 22, wherein the at least one sensor senses whether the two parts are in conducting positions.

24. The system according to claim 22, wherein the zipper, the at least one conductive cable, the at least one controller and the at least one sensor are attachable to an article of clothing, the at least one sensor sensing at least one of a closed position of the zipper, a bodily function of a person wearing the article of clothing, and a condition external to the article of clothing.

25. The system according to claim 22, wherein the controller comprises a mobile device.

26. The system according to claim 25, wherein the mobile device comprises one of a wireless phone, a mobile computing device, and a Personal Digital Assistant (PDA).

27. The system according to claim 22, further comprising insulating interlocking teeth, the insulating interlocking teeth being part of the plurality of interlocking teeth, the insulating interlocking teeth residing at locations on the zipper between two pairs of conducting interlocking teeth.

28. The system according to claim 22, wherein the zipper includes some interlocking teeth that are not insulating teeth and are not conducting interlocking teeth.

29. The system according to claim 22, further comprising at least one electronic device, the at least one electronic device operably connected to the zipper through at least one conducting cable.

30. The system according to claim 29, wherein the at least one electronic device comprises at least one of a headset, a microphone, a light, a sensor, a processor, a wireless device, a display, a switch, a receiving device, a storage device, a transmitting device, an audio device, a thermal device, an input/output device, and a power source.

31. The system according to claim 29, wherein the at least one electronic device is operably connected to the controller, the controller controlling the at least one electronic device based on the sensing.

32. The system according to claim 22, wherein the zipper, the at least one conductive cable, the at least one controller and the at least one sensor are attachable to an article of clothing, the at least one conductive cable being woven into the fabric of the article of clothing.

33. The system according to claim 22, wherein the at least one conductive cable comprises conductive metal.

34. A zipper assembly comprising:

a zipper, the zipper including a plurality of interlocking teeth; and at least one conductive cable, each at least one conductive cable comprising parts of conductive fiber, each of the two parts being integral with one tooth of a pair of conducting interlocking teeth that are part of the plurality of interlocking teeth, the two parts being brought into conducting positions forming the at least one conductive cable when the part of conducing interlocking teeth are interlocked, the conducing position allowing information transfer through the at least one conductive cable.

35. The zipper according to claim 34, further comprising insulating interlocking teeth, the insulating interlocking teeth being part of the plurality of interlocking teeth, the insulating interlocking teeth residing at locations on the zipper between two pairs of conducting interlocking teeth.

36. The zipper according to claim 35, wherein the zipper includes some interlocking teeth that are not insulating teeth and are not conducting interlocking teeth.

37. The zipper according to claim 34, wherein the at least one conductive cable comprises conductive metal.

* * * * *